US009341078B2

(12) United States Patent
Davis

(10) Patent No.: US 9,341,078 B2
(45) Date of Patent: May 17, 2016

(54) BLADE FOR A TURBO MACHINE HAVING LABYRINTH SEAL COOLING PASSAGE

(75) Inventor: Anthony Davis, Bassingham (GB)

(73) Assignee: SIEMENS AKTIENGESELLSCHAFT, München (DE)

( * ) Notice: Subject to any disclaimer, the term of this patent is extended or adjusted under 35 U.S.C. 154(b) by 468 days.

(21) Appl. No.: 13/818,121

(22) PCT Filed: Aug. 8, 2011

(86) PCT No.: PCT/EP2011/063641

§ 371 (c)(1),
(2), (4) Date: Feb. 21, 2013

(87) PCT Pub. No.: WO2012/028424

PCT Pub. Date: Mar. 8, 2012

(65) Prior Publication Data

US 2013/0156598 A1 Jun. 20, 2013

(30) Foreign Application Priority Data

Aug. 30, 2010 (EP) ..... 10174523

(51) Int. Cl.

| | |
|---|---|
| ***F01D 5/18*** | (2006.01) |
| ***F01D 11/04*** | (2006.01) |
| ***F01D 25/12*** | (2006.01) |
| ***F01D 5/08*** | (2006.01) |

(52) U.S. Cl.

CPC ..... *F01D 25/12* (2013.01); *F01D 5/082* (2013.01); *F01D 5/187* (2013.01); *F01D 11/04* (2013.01); *F05D 2240/81* (2013.01); *F05D 2260/201* (2013.01)

(58) Field of Classification Search

CPC ..... F01D 11/04; F01D 5/082; F05D 2240/81; F05D 2240/80

USPC ..... 416/193 A

See application file for complete search history.

(56) References Cited

U.S. PATENT DOCUMENTS

| | | | | |
|---|---|---|---|---|
| 5,358,374 | A | 10/1994 | Albrecht | |
| 5,470,198 | A | 11/1995 | Harrogate et al. | |
| 5,538,394 | A * | 7/1996 | Inomata et al. | 416/97 R |
| 5,609,466 | A * | 3/1997 | North et al. | 415/115 |
| 5,639,216 | A * | 6/1997 | McLaurin et al. | 416/95 |
| 6,082,961 | A | 7/2000 | Anderson | |
| 2005/0201857 | A1 * | 9/2005 | Ferra et al. | 415/115 |
| 2007/0020100 | A1 * | 1/2007 | Beeck et al. | 416/193 A |

(Continued)

FOREIGN PATENT DOCUMENTS

| | | | |
|---|---|---|---|
| DE | 19807563 | A1 | 9/1998 |
| EP | 1178181 | A2 | 2/2002 |

(Continued)

*Primary Examiner* — Bryan Lettman
*Assistant Examiner* — Timothy P Solak

(57) ABSTRACT

A blade for a turbomachine, for example a gas turbine, is provided. The blade is arranged on a turbine rotor of the gas turbine. The blade includes a root portion having two narrow sides and two broad sides, a cooling air supply passage in the root portion, and a cooling air bleed which is arranged in the root portion and is in fluid connection with the cooling air supply passage. The cooling air bleed includes a nozzle on one of the narrow sides of the root portion, wherein the nozzle is formed by a hole and wherein an axial direction of the hole is inclined upward between 92° and 135° with respect to a longitudinal direction of the blade.

14 Claims, 3 Drawing Sheets

(56) References Cited

U.S. PATENT DOCUMENTS

| | | | | |
|---|---|---|---|---|
| 2007/0077144 | A1* | 4/2007 | Lee et al. | 416/193 A |
| 2009/0232660 | A1* | 9/2009 | Liang | 416/97 R |
| 2010/0008760 | A1* | 1/2010 | Morris et al. | 415/115 |
| 2010/0183426 | A1* | 7/2010 | Liang | 415/110 |
| 2012/0070305 | A1* | 3/2012 | Ammann | F01D 5/082 416/97 R |

FOREIGN PATENT DOCUMENTS

| | | |
|---|---|---|
| EP | 1205634 A2 | 5/2002 |
| EP | 2037081 A1 | 3/2009 |
| RU | 2183747 C1 | 6/2002 |
| RU | 2331777 C2 | 8/2008 |

* cited by examiner

BLADE FOR A TURBO MACHINE HAVING LABYRINTH SEAL COOLING PASSAGE

CROSS REFERENCE TO RELATED APPLICATIONS

This application is the US National Stage of International Application No. PCT/EP2011/063641 filed Aug. 8, 2011, and claims the benefit thereof. The International Application claims the benefits of European Patent Application No. 10174523.0 EP filed Aug. 30, 2010. All of the applications are incorporated by reference herein in their entirety.

FIELD OF THE INVENTION

The invention relates to a blade for a turbomachine, particularly a gas turbine, the blade particularly being arranged on a turbine rotor of the gas turbine. Furthermore, the invention relates to a turbomachine with a blade.

BACKGROUND OF THE INVENTION

Gas turbines known in the state of the art comprise a compressor, possibly divided in a low pressure compressor and a high pressure compressor. Furthermore, gas turbines have a combustor, where gas is mixed with compressed air. After exiting the combustor, the high energy gas stream then expands through the turbine, where energy is extracted to operate the compressor and produce mechanical work i.e. a torque.

The pressure turbine is usually divided into a high pressure turbine and a low pressure turbine, wherein the high pressure turbine can include more than one stage as well as the low pressure turbine includes typically several stages. Each stage typically includes a rotor and a stator. The rotor disc, also referred to as the turbine rotor, rotates about a centre line axis or a longitudinal axis of the gas turbine.

On the rotor disc, several blades are arranged and extend radially into the gas stream. These blades have to withstand high temperatures and high mechanical forces due to the rotation of the turbine rotor. Therefore, typical blades comprise a cooling system with a cooling air supply passage in a root portion of the blade. Cooling air is supplied to holes of an airfoil of the blade to cool the surface of the airfoil by creating a cooling film.

A stator is typically arranged upstream of the rotor. The stator comprises guide vanes. The guide vanes, also referred to as nozzle guide vanes, NGV, are static vanes for guiding the expending gas stream onto the airfoils of the blades of the rotor.

To prevent high temperature gas from entering the inner region of the turbine, the nozzle guide vanes as well as the blades comprise platforms forming a labyrinth-sealing.

Problems arise with extreme front or rear edges of platform regions of the nozzle guide vanes. The problem is that these regions are subject to hot gas temperatures but are difficult to cool. This sometimes causes oxidation during service.

Typical cooling methods for these extreme regions of NGV-platforms include impingement jets to the underside of the platform.

European patent application EP1 178 181 A2 shows a system for cooling the platform of a blade. Similar techniques can be used for cooling the platform of a nozzle guide vane. From European patent application EP 1 205 634 A2 it is known to embody a platform of a blade with a hollow cavity in fluid communication with a cooling air channel. The cavity is further provided with straight outlet holes directed to an adjacent band of a vane for cooling the latter. US patent application US 2009/0232660 A1 describes to provide a platform of a blade with internal cooling passages for cooling of the platform. These passages extend from cooling channels in a root of the blade to sides of the root and are arranged inclined and downward in respect to a longitudinal direction of the blade. However, the jets produced by such arrangements are not able to reach the extreme edge of the platform due to mechanical and seal features at these locations.

SUMMARY OF THE INVENTION

It is an object of the invention to provide improved blades for turbo machines and to provide an improved turbo machine. Especially the cooling of extreme edge regions of a platform of the adjacent nozzle guide vanes should be improved to enhance service time of these parts of the engine.

According to the invention a blade for a turbomachine, particularly a gas turbine, is provided, the blade particularly being arrangeable or arranged on a turbine rotor of the gas turbine. The blade is comprising a root portion having two narrow sides and two broad sides, a cooling air supply passage in the root portion, and a cooling air bleed being arranged in the root portion and being in fluid connection with the cooling air supply passage. According to the invention the cooling air bleed comprises a nozzle on one of the narrow sides of the root portion.

Typical embodiments of the invention comprise a nozzle on one of the narrow sides of the root portion. The narrow sides of the root portion are the two sides of the root portion, which are substantially perpendicular to the direction of flow of the hot gas stream in the gas turbine. Hence, the two narrow sides of the root portion are at least substantially perpendicular to the axis of rotation of the turbine rotor carrying the blades. The two narrow sides are the sides on both axial ends of the root portion, i.e. the upstream side and the downstream side in regards of a main fluid path of the turbomachine.

The nozzle is formed by a hole. An axial direction of the hole—i.e. an axial component of a vector of orientation of the hole—is inclined upward between 92° and 135° with respect to the longitudinal direction of the blade. Other possible lower limits could be 95°, 100°, 110°, or 120°. Other possible upper limits could be 110°, 120°, or 130°. "Upwards" means in direction of the main flow path or away from the axis of rotation of the gas turbine rotor. In other words, upwards means a direction from a blade root to the blade air-foil. The hole is a fluid passage, the fluid passage is oriented with an axial component—parallel to the rotating axis of the turbomachine—, a radial component—perpendicular to the rotating axis of the turbomachine—and a circumferential component—perpendicular to the axial and radial components. Thus, inclined upwards means that the passage has a radial component away from the rotating axis, the radial component is not equal to zero. Furthermore the axial component is opposite to the main fluid flow within the turbomachine, the axial component is not equal to zero. The circumferential direction may be zero or may be also not equal to zero.

The hole—i.e. the fluid passage—may be formed substantially cylindrical.

The advantage of the nozzle is that cooling air is directed to an edge of the platform region of the nozzle guide vane, assuming the blade is assembled in the turbomachine and the turbomachine is operating. This is particularly advantageous for a direct cooling of the extreme edge of the platform region of the nozzle guide vane. Particularly the trailing edge of the nozzle guide vane may be cooled of an adjacent nozzle guide vane, which is located upstream of the blade.

An extreme edge of the platform region of the nozzle guide vane is intended to mean a rim, a tip, a nose, a cone end and/or a lip of the platform region of the nozzle guide vane that is directed towards the blade. It should be noted that the two broad sides of the blade are advantageously formed like a dove tail or a fir tree for a secure fixation of the blade in the rotor disc of the turbine rotor.

In a particular realization of the invention the nozzle is formed by a hole machined in the root portion. The hole is advantageously oval, in particular circular. This avoids notch stresses.

It is particularly advantageous that an axial direction of the hole is directed at least partially in a longitudinal direction of the blade. The longitudinal direction of the blade can also be referred to as the radial direction of the turbine rotor. Such an alignment of the hole has the advantage that the cooling air jet is accelerated by the rotation of the blade.

Typically, the axial direction of the hole is inclined between 92° and 135°, especially more than 95° or less than 120°, with respect to the longitudinal direction of the blade. Such an alignment of the hole promotes a better cooling of the edge of the platform region of the nozzle guide vane.

In typical embodiments, the axial direction of the hole lies at least essentially in a plane, the plane being orientated radial with respect to the axis of rotation of the turbine rotor. Considering that the blade is in a rotating system whereas the guide vanes are in a fixed system, the jet of cooling air will reach the guide vanes at an angle with the axis of the hole lying in the mentioned plane. Furthermore, typical embodiments comprise a hole with an axial direction being inclined with respect to a radial plane of the turbine rotor. If the resulting direction of the cooling air jet is in the same direction as the rotation of the blade the cooling effect will be the highest. If the resulting direction of the jet is in the opposite direction as the rotation of the blade the jet will generate a torque i.e. improving the efficiency but provide reduced cooling. Preferred turbine rotors comprise blades having holes which axial directions are different with respect to a radial plane of the rotating axis of the turbine rotor.

Preferably, the blade comprises an upper blade platform—in direction of the airfoil—and a lower blade platform—in direction of the blade root —, wherein the nozzle is arranged between the upper blade platform and the lower blade platform. This arrangement avoids the handicap that a cooling air stream for the edge of the platform region is hindered by the labyrinth seal of the platforms. The seal is conventionally formed by the platforms, such that a cooling air bleed between the platforms serves for a better cooling of parts in between the seal. In typical embodiments, the nozzle is placed below the upper platform or above the lower platform.

Further preferred embodiments have a nozzle below the lower platform or above the upper platform. Furthermore, embodiments having a nozzle formed within a platform of the blade can provide a better cooling of the platform region of the nozzle guide vanes. Preferred embodiments provide a plurality of nozzles, e.g. two, three or even more nozzles, positioned at the above mentioned positions. A plurality of nozzles may provide better cooling. Generally, the location of the nozzle depends on the design and stress distribution of the blade root region, the design of the nozzle guide vane platform, the amount of hot gas ingress into the cavity or whether platform region needs cooling.

In a further advantageous implementation the nozzle or the hole is arranged on a front surface of the root portion. The front surface of the root portion is the surface being aligned perpendicular to the axis of rotation of the rotor disc of the turbine rotor. The front surface may be particularly an upstream surface.

Particular realizations comprise a plurality of nozzles on one of the narrow sides of the root portion. The plurality of nozzles has the advantage, that more cooling air can be guided to the platform region of the nozzle guide vane. Furthermore, more nozzles can be used to reduce the diameter of one of the holes of the nozzle. This serves for a better strength of the blade.

A further aspect of the invention is related to a turbo machine comprising a turbine rotor with at least one blade according to the above described realizations. Such a turbo machine has the advantage that a platform region of the nozzle guide vane is cooled by the cooling air from the holes in the root portion of the blade.

Generally, the invention has the advantages that a high amount of cooling air to the extreme edges of the inner platform region of a nozzle guide vane is provided. In fact, the invention provides a better cooling than jets to the underside of the platform. Moreover, the invention is better than methods using convection cooling which only provide a moderate amount of cooling.

It should be noted that the rotation of the blade on the turbine rotor increases the cooling air pressure, so increasing the impingement effect of the jets, and also distribute the cooling air to the circumferential positions of the non-gas washed surface at the extreme front and rear of the inner platform.

In a preferred embodiment, both narrow sides comprise a plurality of nozzles. This has the advantage that platform regions of the nozzle guide vanes on both sides of the turbine rotor can be cooled.

BRIEF DESCRIPTION OF THE DRAWINGS

The invention will now be further described, with reference to the accompanying drawings, in which.

DETAILED DESCRIPTION OF A PREFERRED EMBODIMENT

Figure 1:
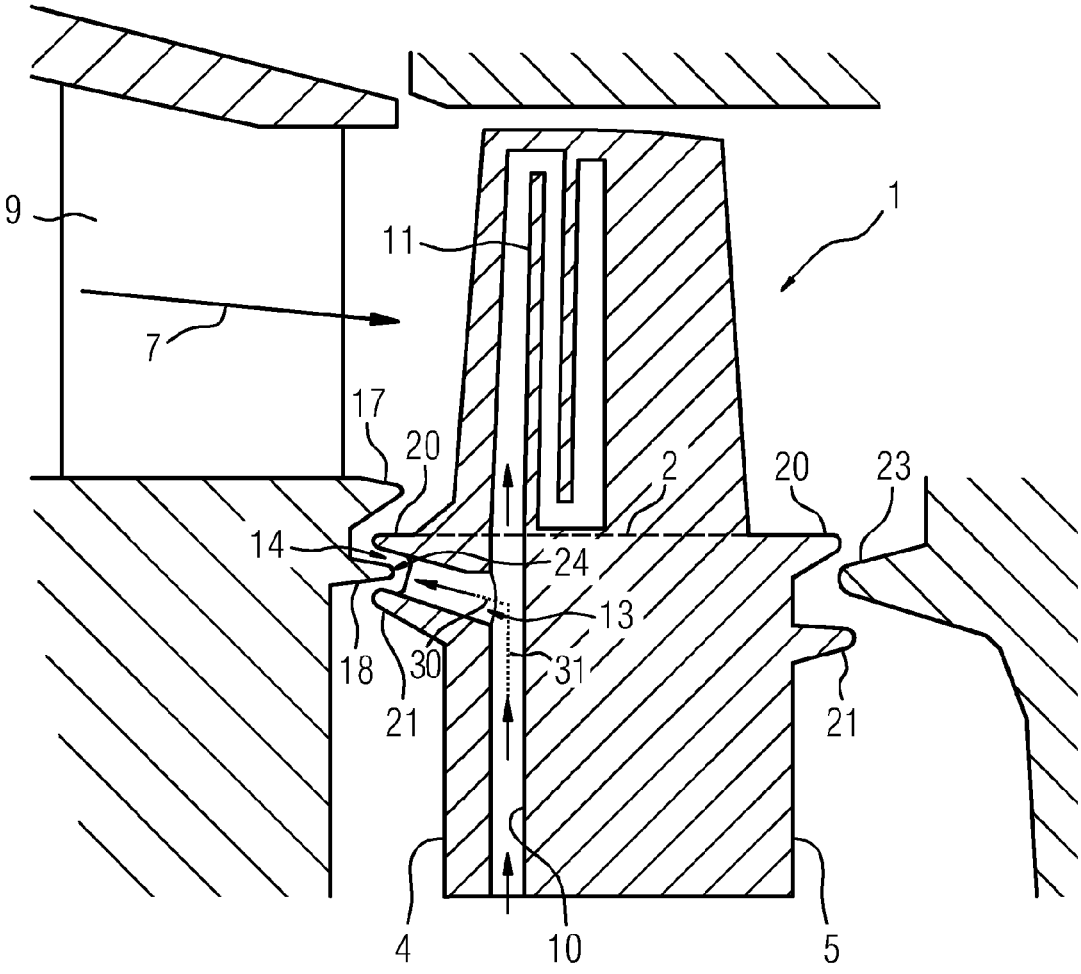
FIG. 1 is a partly sectional view of parts of a gas turbine with a blade according to a preferred embodiment of the invention.

FIG. 1 shows in a partly sectional view parts of a stationary gas turbine. Especially, a blade 1 is shown. The blade 1 comprises a root portion. The root portion is the area under a dotted line 2 in FIG. 1. The root portion has four side walls, also referred to as sides, namely two narrow sides 4 and 5 and two broad sides, which are parallel to the plane of projection of FIG. 1.

Furthermore, the blade 1 comprises an airfoil which is depicted in FIG. 1 above the dotted line 2. The airfoil of blade 1 is arranged in a channel for a stream of hot gas 7—a main flow path of working fluid. The hot gas 7 is directed over the airfoil of the blade 1 to extract energy from the hot gas 7 for rotating a turbine rotor. The blade 1 is arranged on the turbine rotor (not shown).

Figure 3:
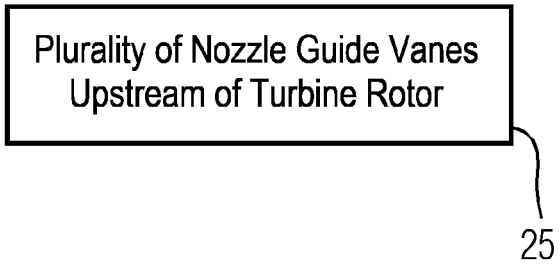
FIG. 3 illustrates a plurality of nozzle guide vanes.

A nozzle guide vane 9 (NGV) is arranged upstream of the airfoil of the blade 1. The nozzle guide vane 9 provides a constant and directed stream of hot gas 7 to rotating airfoils like the airfoil of blade 1. It should be noted that during rotation of the turbine rotor airfoils of several blades pass the nozzle guide vane 9. On the other hand, in the circumferential channel for the hot gas 7, (as illustrated in FIG. 3) a plurality 25 of nozzle guide vanes 9 are arranged for directing the flow of hot gas 7.

The blade 1 is typically a unitary casting of high strength metal containing high amounts of alloying elements such as nickel. The blade 1 is suitable for withstanding the high temperature of the hot gas 7 during operation. Additionally the material forming the blade 1 is suitable for high stresses in combination with high temperatures. This is due to the fact that during rotation of the turbine rotor, the blade 1 is subject to high forces.

Nevertheless, a cooling system should be provided for cooling at least some regions of the blade 1 during operation. For this purpose, a cooling air supply passage 10 is arranged in the root portion of the blade 1.

The cooling air supply passage 10 serves for guiding cooling air into a serpentine cooler 11 which is arranged inside of the airfoil of the blade 1. Typically, airfoil of the blade 1 comprises openings for directing cooling air to the surface of the airfoil of the blade 1.

The preferred embodiment shown in FIG. 1 comprises an additional cooling air bleed 13 being arranged in the root portion and being in fluid connection with the cooling air supply passage 10. The cooling air bleed 13 comprises a nozzle 14 on the narrow side 4 of the root portion of the blade 1.

The nozzle 14 is formed by a hole machined in the root portion. The axial direction 30 of the hole of the nozzle 14 is directed at least partially in a longitudinal direction 31 of the blade 1. The longitudinal direction 31 of the blade 1 is a radial direction with respect to the rotating turbine rotor on which the blade 1 is fixed.

In FIG. 1, the hole of the nozzle 14 is directed slightly upwards. Upwards means in direction of the main flow path or away from the axis of rotation of the gas turbine rotor. In other words, upwards means a direction from a blade root to the blade airfoil. The upward angle of the longitudinal direction 30 of the hole of the nozzle 14 with respect to the longitudinal axis 31 of the blade 1 is between 92° and 135° degrees such as between 100° and 115°. Such an angle ensures that the cooling air jet through nozzle 14 is accelerated by the rotation of the turbine rotor. Moreover, the bleed 13 or the axial direction of the hole of the nozzle 14 of the bleed 13, respectively, is inclined in respect to a direction of a main flow path or the stream of the hot gas 7.

The cooling air leaving the nozzle 14 impinges directly the extreme edges of platform region 17 and 18 of the nozzle guide vane. Therefore, cooling of the extreme edges of the platform regions 17 and 18 of the nozzle guide vane is ensured. The acceleration of the cooling air due to the rotation of the turbine rotor further enhances the cooling effect of the cooling air impinging the platforms of the nozzle guide vanes.

It should be noted that the platform regions 17 and 18 together with an upper blade platform 20 of the blade 1 and a lower blade platform 21 of the blade 1 form a labyrinth-sealing. The labyrinth-sealing separates the inner regions of the gas turbine from the channel filled with the hot gas 7.

The inner regions of the gas turbine are flooded with cooling air. However, in the region of the labyrinth-sealing formed by platforms 17, 18, 20 and 21 convection cooling with cooling air from the inner region of the gas turbine may not be enough, at least in some situations. At this point the invention with the jet of cooling air through the nozzle 14 has the advantage of a better cooling of platform regions 17 and 18.

Particularly cooling air will be directed via the cooling air bleed 13 towards a rim and/or a tip 24 of the platform region 18, the rim and/or the tip 24 being part of the labyrinth-sealing and directed towards the blade. Cooling air may hit the rim and/or the tip 24 and an upper surface of platform region 18, optionally also a lower surface of platform region 18.

On the downstream side of blade 1, a further platform region 23 of a downstream nozzle guide vane is arranged. The further platform region 23 can be cooled when necessary with an additional cooling air bleed.

Such an additional cooling air bleed comprises a further nozzle between the upper blade platform 20 and the lower blade platform 21 on the downstream narrow side 5 of blade 1. The further nozzle provides a machined hole as well as the nozzle directed on the platform regions 17 and 18. Again, a hole with an inclined angle provides the advantage of a further acceleration of the cooling air.

Figure 2:
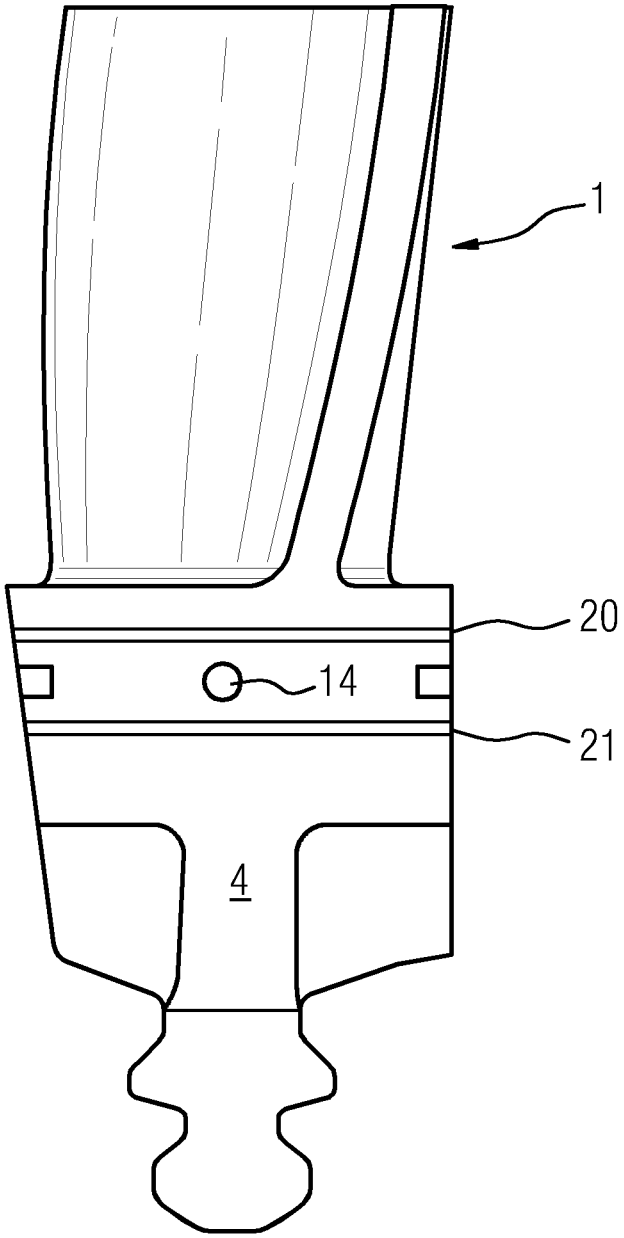
FIG. 2 shows the blade of FIG. 1 in a side elevational view schematically.

In FIG. 2, a schematic view of blade 1 is depicted. It should be noted that same parts in FIG. 2 have same reference signs as in FIG. 1. For the sake of clearness, these parts are not been described again.

In FIG. 2, the nozzle 14 with its machined hole on the narrow side 4 of the blade 1 is shown. The hole is arranged between the upper blade platform 20 and the lower blade platform 21. The broad sides of the root region of the blade 1 are formed like a dovetail to ensure a secure fixing of the blade 1 in the rotor disc of the turbine rotor (rotor disc not shown in the figures).

In typical embodiments, the nozzle is placed below the upper platform or above the lower platform. As mentioned above, other positions may provide better cooling depending on the design of the platforms. Also design and stress conditions may influence the positioning of the nozzle.

Further typical embodiments of the invention comprise more than one hole between the upper platform region. As the blades 1 of a turbine rotor pass several nozzle guide vanes, the holes of the nozzles 14 of the several blades 1 are moving along the extreme edges of the platform region of the nozzle guide vane (see FIG. 1). Therefore, a continuous cooling of the platform region is ensured—even though the cooling air is distributed by holes being spaced apart.

As a further positive side effect, the sealing between the channel for the hot gas 7 and the inner region of the turbo machine is improved. Therefore, not only the extreme edges of the platform regions of the nozzle guide vane are subject to a better cooling. With the invention, the whole area including extreme edges of the platforms of the blade is provided with a better cooling reducing corrosion and wear.

Even though the embodiments show a blade of a gas turbine as an example, the same principle of cooling can also be advantageously applied to blades of other turbo machines. Moreover, the invention is not confined to the described preferred embodiment. The scope of the invention is restricted only by the claims.

The invention claimed is:

1. Blade for a turbomachine, comprising:

an airfoil and a root portion, both being unitary to said blade;

said airfoil having a cooler arranged inside the airfoil;

said a root portion having two narrow sides and two broad sides;

a cooling air supply passage in the root portion that guides cooling air into the cooler; and a cooling air bleed arranged in the root portion and in fluid connection with the cooling air supply passage;

wherein the cooling air bleed comprises a nozzle on one of the narrow sides of the root portion, and wherein the nozzle is formed by a hole, wherein the blade root portion comprises an upper blade platform and a lower blade platform, wherein the upper blade platform and the lower blade platform are embodied as parts of a labyrinth-sealing when assembled in the turbomachine, and wherein the nozzle is arranged between the upper blade platform and the lower blade platform, and wherein an axial direction of the hole is inclined upward between 92° and 135° with respect to a longitudinal direction of the blade.

2. The blade according to claim 1, wherein the hole of the nozzle is machined into the root portion.

3. The blade according to claim 1, wherein the nozzle is arranged on a front surface of the blade.

4. The blade according to claim 1, wherein the nozzle is arranged for generating an air flow which is directed towards a platform region of an adjacent guide vane when assembled in the turbomachine.

5. The blade according to claim 4, wherein the air flow is directed towards a rim and/or tip of the platform region, and wherein at least one of the rim, the tip, or a combination thereof, is directed towards the blade when assembled in the turbomachine.

6. The blade according to claim 4, wherein at least one of the rim, the tip, or a combination thereof, is part of the labyrinth-sealing when assembled in the turbomachine.

7. The blade according to claim 1, wherein the cooling air bleed comprises a plurality of nozzles on one of the narrow sides of the root portion.

8. A turbomachine, comprising:

a turbine rotor with at least one blade according to claim 1.

9. The turbomachine according to claim 8, further comprising:

a plurality of guide vanes being arranged upstream of the turbine rotor, wherein the nozzle arranged in the root portion of the at least one blade is directed towards a platform region of the guide vanes.

10. The turbomachine according to claim 9, wherein the nozzle is directed to an edge, which is embodied as a rim, a tip, or combination thereof, of the platform region of the nozzle guide vane.

11. The turbomachine according to claim 9, wherein the platform regions of the nozzle guide vane together with the upper blade platform and the lower blade platform of the at least one blade form the labyrinth-sealing.

12. The turbomachine according to claim 11, wherein the labyrinth-sealing separates inner regions of the gas turbine from a channel filled with a hot gas.

13. The turbomachine according to claim 8, wherein an axial direction of the hole of the cooling air bleed, lies at least essentially in a radial plane of the turbine rotor.

14. The turbomachine according to claim 8, wherein an axial direction of the hole of the cooling air bleed is inclined with respect to a radial plane of the turbine rotor, and wherein the axial direction of the hole has a same direction as a direction of rotation of the blade.

* * * * *